US006652679B1

(12) United States Patent
Inoue et al.

(10) Patent No.: US 6,652,679 B1
(45) Date of Patent: Nov. 25, 2003

(54) HIGHLY-DUCTILE NANO-PARTICLE DISPERSED METALLIC GLASS AND PRODUCTION METHOD THEREFOR

(75) Inventors: Akihisa Inoue, Sendai (JP); Tao Zhang, Sendai (JP)

(73) Assignee: Japan Science and Technology Corporation, Kawaguchi (JP)

( * ) Notice: Subject to any disclaimer, the term of this patent is extended or adjusted under 35 U.S.C. 154(b) by 0 days.

(21) Appl. No.: 09/856,166

(22) PCT Filed: Dec. 3, 1999

(86) PCT No.: PCT/JP99/06802

§ 371 (c)(1),
(2), (4) Date: Oct. 26, 2001

(87) PCT Pub. No.: WO00/32833

PCT Pub. Date: Jun. 8, 2000

(30) Foreign Application Priority Data

Dec. 3, 1998 (JP) ..... 10-344656

(51) Int. Cl.[7] ..... C22C 45/10; C22F 1/18
(52) U.S. Cl. ..... 148/561; 164/113; 29/17.2
(58) Field of Search ..... 148/403, 561; 164/113, 119; 29/17.2

(56) References Cited

U.S. PATENT DOCUMENTS 5,324,368 A * 6/1994 Masumoto et al. ..... 148/561
5,976,274 A * 11/1999 Inoue et al. ..... 148/304
6,044,893 A * 4/2000 Taniguchi et al. ..... 164/70.1
6,074,497 A * 6/2000 Inoue et al. ..... 148/403
6,231,697 B1 * 5/2001 Inoue et al. ..... 148/561
6,261,386 B1 * 7/2001 Perepezko et al. ..... 148/403
6,427,753 B1 * 8/2002 Inoue et al. ..... 164/80

FOREIGN PATENT DOCUMENTS

| | | | |
|---|---|---|---|
| DE | 19833329 A | * | 1/2000 |
| EP | 0 895 823 A1 | | 2/1999 |
| EP | 1138798 A1 | * | 10/2001 |
| JP | 11-189855 | | 7/1999 |
| JP | 2000-24771 | | 1/2000 |
| JP | 2000-26944 | | 1/2000 |
| WO | WO-98/56523 A1 | * | 12/1998 |

OTHER PUBLICATIONS

Patent Abstract of Japan, Publication No. JP5253656, dated Oct. 5, 1993.

(List continued on next page.)

*Primary Examiner*—George Wyszomierski
(74) *Attorney, Agent, or Firm*—Armstrong, Westerman & Hattori, LLP

(57) ABSTRACT

The present invention intends to provide a production method for a highly reliable bulk metallic glass of a high cold draft of 70% or more, and better post-cold working mechanical properties than those of the metallic glass being cast. The bulk metallic glass is obtained by pressing and expanding an alloy melt of composition capable of being glassified between the cooled upper and lower molds, which are highly heat-conductive water-cooled molds, so as to apply pressure to the melt while it is solidified. Nano-particles are thus dispersed in the amorphous phase of the metallic glass, thereby obtaining a metallic glass with nano-particles dispersed in its amorphous phase. The metallic glass with nano-particles of such a high ductility is further cold worked, for example by rolling to make the final product.

4 Claims, 1 Drawing Sheet

OTHER PUBLICATIONS

Patent Abstract of Japan, Publication No. JP8109419, dated Apr. 30, 1996.
Patent Abstract of Japan, Publication No. JP8120363, dated May 14, 1996.
Patent Abstract of USP No. 5803996, dated Sep. 8, 1998.
Patent Abstract of USP No. 5711363, dated Jan. 27, 1998.
Patent Abstract of Japan, Publication No. JP10216920, dated Aug. 18, 1998.
Patent Abstract of Japan, Publication No. JP10249600, dated Sep. 22, 1998.
Patent Abstract of USP No. 5368659, dated Nov. 29, 1994.
Patent Abstract of Japan, Publication No. JP7188878, dated Jul. 25, 1995.
Patent Abstract of Japan, Publication No. JP8109454, dated Apr. 30, 1996.
Patent Abstract of Japan, Publication No. JP9300063, dated Nov. 25, 1997.
Patent Abstract of Japan, Publication No. JP10218700, dated Aug. 18, 1998.
Patent Abstract of Japan, Publication No. JP8168868,dated Jul. 2, 1996.

* cited by examiner

HIGHLY-DUCTILE NANO-PARTICLE DISPERSED METALLIC GLASS AND PRODUCTION METHOD THEREFOR

TECHNICAL FIELD

The present invention relates to a highly ductile bulk metallic glass, cold worked products made of the highly ductile bulk metallic glass, and its production method.

BACKGROUND OF THE INVENTION

A popular casting method for producing bulk amorphous alloy product is disclosed, for example, in Japanese patent Kokai H5-253656, in which a tubular product is made by forming a cavity of a combination of a core and a mold made of a metal having a high thermal conductivity, and a melt of such as La based alloy or Zr based alloy is injected into the cavity. A ½ volume or more of the resulting metallic glass is in an amorphous phase or nano-crystals of less than 100 nm in this art.

Compositions of amorphous alloys, known as metallic glasses, are being developed in the industry. Conventional production methods include the ones the inventors have disclosed. They are (1) the differential pressure casting technique (Japanese Kokai No. H8-109419), (2) the zone melting technique (Japanese Kokai No. H8-120363), and (3) the die casting technique (Japanese Kokai No. H8-199318). Yet there is another patent application which discloses a new composition and production method of an amorphous alloy. Japanese Kokai No. H9-323146 discloses a composition of 41.2 atomic % Zr, 13.8 atomic % Ti, 10.0 atomic % Ni, 12.5 atomic % Cu, and 22.5 atomic % Be, and the alloy melt is injected into a die-cast at 500 psi or greater.

Generally, a metallic glass material is formed by taking advantage of good viscous flow that exists in the supercooled liquid region of an amorphous alloy. Japanese Kokai No. H10-216920 and Japanese Kokai No. H10-249600 disclose a method in which a metallic glass material is heated to a temperature within the supercooled region, followed by press molding the metallic glass. Japanese domestic announcement Kohyo No. 8-508545 discloses a metallic glass of a composition expressed by the following chemical formula: $(Zr_{1-x}Ti_x)_a(Cu_{1-y}Ni_y)_bBe_c$, wherein the composition is excellent in bending ductility and can be rolled to have ⅓ of the initial thickness.

However, a metallic glass having an alloy composition of $Zr_{55}Cu_{30}Al_{10}Ni_5$, for example, has a transition temperature (Tg) of 420° C. and a crystallization temperature (Tx) of 500° C. The metallic glass of this type is viscously fluid in the supercooled liquid region, which exists between the transition temperature and the crystallization temperature. Although this type can be formed well within the supercooled liquid region, the metallic glass product made by the conventional rapid cooling technique has a draft (reduction ratio) of only 40% at maximum when cold rolled.

There have been no reports teaching that a bulk metallic glass can possibly be cold rolled if the bulk metallic glass is made by such conventional casting techniques as melt forging; die casting; press molding of a melt injected into a mold; dual-roller solidification, or by the conventional water quenching technique. Moreover, the inventors' experiments even confirmed that it is impossible to cold rolling a bulk metallic glass made by conventional technology.

Some amorphous alloys, having a fine crystalline structure consisting of nano-particles of less than 100 nm in a amorphous phase matrix, are known for their improved mechanical and chemical properties. For these alloys, a fine crystalline structure consisting of nano-particles is obtained by heating an amorphous alloy at a temperature below its crystallization temperature. (Japanese Kokai No. H7-188878; Japanese Kokai No H8-109454; Japanese Kokai No. H9-300063; and Japanese Kokai No. H10-218700.)

DETAILED DESCRIPTION OF THE INVENTION

Issues to be Resolved by the Invention

The inventors of the present invention have studied the quenching technique for making a metallic glass of excellent cold deformation properties, and confirmed that alloys of Zr—Ti—Al—Cu—Ni system are excellent in their glass forming capability, heat stability, and mechanical properties. The inventors also found that the critical cooling rate for glassifying this alloy system was 10–100 K/s, at which a bulk metallic glass of 30 mm or less in diameter can be obtained by a variety of casting techniques. The alloy had an improved draft of 50% or more when cold rolled, and the cold rolled metallic glass sheet shows an excellent toughness. For example, the alloy glass could be cold rolled using regular rollers to obtain a very thin metallic glass sheet reflecting its ability to be reduced by 90% or more.

Nonetheless, such a thin metallic glass sheet made by a conventional casting technique had a drawback, in that its hardness deteriorated, and its tensile strength became poorer than that of an as-cast material as a draft increased. The process was so immature that it was impossible to produce a highly reliable material. To resolve the issue, the present invention intends to provide a bulk metallic glass, that is suited to cold working (e.g. cold rolling) because of its excellent draft ("cold rolling reduction ratio" for cold rolling) of 70% or more and its excellent mechanical properties. More specifically, the required mechanical properties after cold rolled are better elastic elongation and bending properties than those of the glass as cast. These properties can provide sheet materials or wire materials of various cross sections. The present invention also intends to provide the production method of the bulk metallic glass.

MEANS TO RESOLVE THE PROBLEM

The inventors rigorously studied ways to make a bulk metallic glass of excellent ductility and having post cold rolling mechanical properties that is in a mono glassy phase and a mixture of glass phase and crystalline phase, or a mixture of glass phase and nanocrystalline phases (ultra fine crystals of 100 nm or less). The inventors, then, found that a novel process, being characterized by dispersion of nano-particles throughout an amorphous phase, can provide such a bulk metallic glass, which could not have been obtained by any of the conventional techniques, such as the rapid cooling, water quenching, melt forging, die casting, press casting of a melt in a mold, in addition to any of the related art that has been developed by the inventors such as the differential pressure casting technique, the zone melting technique, and the casting technique using metallic dies. The present invention is presented herein as a result of the quest.

The first aspect of the present invention is a highly-ductile nano-particle dispersed metallic glass; the bulk metallic glass is obtained by solidifying an alloy melt (hereafter referred to as the "melt press solidification technique") of composition capable of being glassified between a cooled upper mold and a cooled lower mold by pressing and expanding, and nano-particles are dispersed in its amorphous phase, thereby obtaining metallic glass having nano-particles of a draft of 70% or more when cold rolled.

The second aspect of the present invention is a metallic glass with high elastic elongation and excellent bending properties consisting essentially of a single amorphous phase. The metallic glass is obtained by cold working to expand the highly-ductile nano-particle dispersed metallic glass until the nano-particles disappear therefrom.

The third aspect of the present invention is a process of producing highly-ductile nano-particle dispersed metallic glass; the highly-ductile nano-particle dispersed bulk metallic glass is produced by pressing to expand an alloy melt of a composition capable of being glassified between an upper mold and a lower mold. The upper mold and the lower mold are a pair of highly heat-conductive water-cooled casting molds, in which the alloy melt is solidified by a pressing to expand.

One of the preferable modes of the present invention is a process in which the upper and lower molds are positioned in relative proximity such that a melt can be pressed at 0.5–5 $Kg/cm^2$ therebetween in the direction orthogonal to the expanded direction while the melt is being solidified.

Another preferable mode of the present invention is the process in which a water cooled copper mold is used. The copper mold is loaded with an alloy material of a composition capable of being glassified for forming a metallic glass and is melted by an arc melting technique.

The fourth aspect of the present invention is the process of producing a metallic glass of excellent elastic elongation and bending properties obtained by cold working to expand the highly-ductile nano-particle dispersed metallic glass, which is obtained by the melt press solidification technique. The cold working of this invention allows cold rolling of a highly-ductile nano-particle dispersed metallic glass with regular reduction rolls or roller dies, thereby producing sheet materials and wire materials of various cross sections readily.

None of such techniques as die casting, press forming of a melt injected into a mold, differential press molding (the related art of the inventor) could produce a bulk metallic glass dispersed with nano-particles in an amorphous phase is obtained and the amorphous phase providing a draft of 70% or more when cold rolled.

A method of producing a high strength metallic material with a uniform fine structure that is free of voids is disclosed in Japanese Kokai No. H8-168868. The structure is obtained by forging a melt having composition of $Mg_{72}Cu_{20}Y_8$ under supercooled conditions. In this melt forging technique, a melt injected into a mold is pressed at 2,000 $Kgf/cm^2$, which is two digits larger than that of the present invention. This technique is also unable to provide a metallic glass suited to cold working to expand.

The metallic glass material with dispersed nano-particles obtained by the melt press solidification technique of the present invention is characterized in that the metallic glass material with dispersed nano-particles has a smaller number of inner defects than the metallic glass material obtained by any of the conventional casting techniques such as melt forging, die casting, and differential casting, in addition to the water quenching technique. The metallic glass with dispersed nano-particles obtained by the melt press solidification technique is further characterized by nano-particles of about several nm-100 nm dispersed throughout the amorphous phase. As a result, the resulting product has improved plasticity, ductility, and mechanical properties.

Also, according to the melt press solidification technique of the present invention, the metallic glass material obtained by cold drawing the nano-particle dispersed metallic glass such as a cold rolling technique and the like has no nano-particles due to the disappearing of the nano particles by the mechanical alloying effect, thereby creating essentially a single amorphous phase. Compared with the material produced only by the casting process, having tensile strength of 1,700 MPa, elastic elongation rate of 2%, and bending strength of 2,000 MPa, the metallic glass material resulting from cold working of the nano-particle dispersed metallic glass material mentioned above is characterized, for example, by somewhat less tensile strength of 1,506 MPa, an improved elastic elongation rate of 2.8%, and a higher bending strength of 3,000 MPa.

BEST MODE FOR REDUCTION TO PRACTICE

Figure 1:
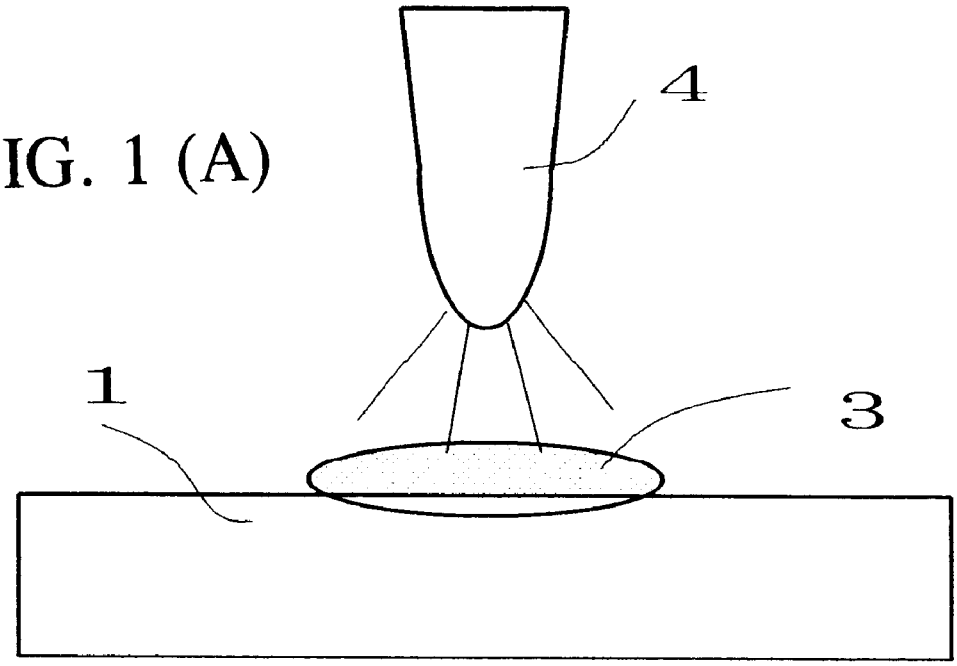
FIG. 1 is a side view showing an apparatus applied for reduction to practice of the present invention.
Figure 1:
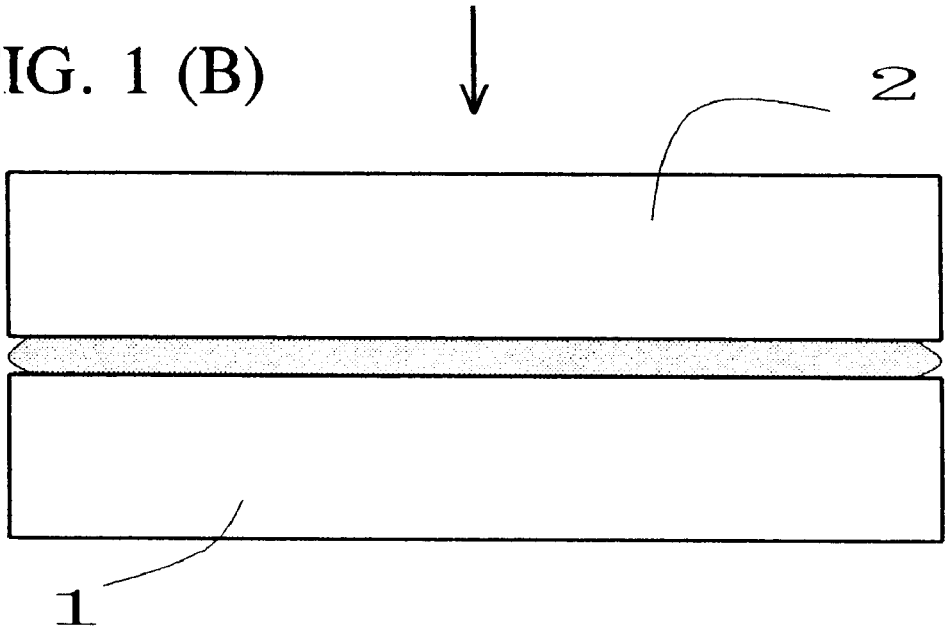

FIG. 1 shows a schematic of an apparatus applied for reduction to practice of the present invention. FIG. 1(A) shows the lower mold, which is the highly heat-conductive, water-cooled mold 1. The top of the lower mold provides a flat surface and its leveled position is maintained. On the flat surface applied is an alloy material or single metal material, which was prepared in advance by melting the material to form an alloy composition that is capable of being glassified for forming a bulk metallic glass. An arc is generated between the tungsten electrode 4 attached on the top of the alloy material and water cooled mold 1, such that the alloy is melted to form a melt puddle 3.

The melt puddle 3, formed by the arc melting technique, holds itself by surface tension on the flat surface of water cooled mold 1 at a given thickness, without requiring any enclosure, as shown in FIG. 1(A). However, an enclosing member, made of a material (e.g. graphite), that can be softened or destroyed by pressure derived from the close proximity of the upper mold and the lower mold, may be attached around the melt puddle 3, such that a melt puddle 3 that is taller than that held by surface tension can be formed.

Immediately after the formation of melt puddle 3, water cooled mold 1 loaded with a melt puddle 3 is moved to the position under the upper mold, which is a highly heat-conductive water cooled mold 2. Instead, tungsten electrode 4 may be moved aside, and the upper mold (water cooled mold 2) may be moved into the place. The upper mold (water cooled mold 2) is then lowered while feeding water thereto until its lower flat surface contacts the melt. The upper mold is further lowered to press the melt. In FIG. 1(B), the bottom surface of the upper mold contacts the melt, taking heat away from the melt. The melt thus begins entering the supercooled state. The surface of the solidifying melt is continued to be pressed to expand between the upper mold and the lower mold that are in an intimate contact as long as the upper mold is lowered. The melt is pressed and expanded from the center of melt puddle 3 to the periphery of the molds while it is in the supercooled state.

As temperatures drop further, the melt is completely solidified and the expansion is terminated when its thickness reaches a given thickness (0.5 mm at minimum) at 1.5–5 $Kg/cm^2$, even though the final thickness of the solidified metallic glass varies, depending on other process conditions such as the thickness of the melt puddle and the duration of press. At this stage obtained is a metallic glass with nanocrystalline particles of several to 100 nm dispersed uniformly throughout its amorphous phase. When a metallic glass sheet of a specific thickness needs to be obtained, a rigid alloy stopper of a specific thickness may be attached to the top surface of mold 1, such that the upper mold and the lower mold make an intimate proximity until the molds reach the height of the stopper.

The desirable duration of press for the process shown in FIG. 1(B) is 0.5–3 minutes. The duration of less than 0.5 minute is not desirable, because the resulting metallic glass will be brittle due to its poor ductility. Solidification completes within three minutes. The ductility of the metallic glass cannot be improved by additional press duration.

The desirable pressure applied during pressing and expanding between the upper mold and the lower mold is 1.5–5 $Kg/cm^2$. At 1.5 $Kg/cm^2$ or less, it is difficult to press and expand the melt. At 5 $Kg/cm^2$ or more, the ductility of the resulting material cannot be improved, and it tends to scratch the mold. The relative speed of the upper mold and the lower mold must be 1 m/s or less. Melt puddle 3 is solidified in a pressing and expanding cycle.

Applicable alloy melting techniques include the arc technique, the electron beam technique, the plasma technique, and the high frequency technique. The arc melting technique is most desirable; it is the arc melting technique that is easier to control than the electron beam technique and the plasma technique, and that produces a cleaner melt using a water-cooled copper crucible than the high frequency melting technique, by which an alloy material is melted in a refractory crucible.

Copper has a high thermal conductivity and is suited to make a mold. Other alloys with high conductivity and strength (e.g. Cu—Cr alloy, Cu—Be alloy, cast iron, carbon material) may also be used to make a mold. Heat insulating boron nitride (BN) may be coated on the surface of the mold as well.

The melt may be pressed and expanded in different forms while it is being solidified between the upper and lower molds, a pair of highly heat-conductive water-cooled molds. The surfaces of the upper and lower molds are not limited to flat surfaces. They may be a combination of relative curvatures. They may also be a combination of a tubular mold and a column-shaped mold that together press and expand the melt puddle at the bottom of the tubular mold while it is being solidified to make a tubular product. The upper mold may be a roller. In this case, a material loaded onto the lower mold is continuously melt by the arc technique, as the roller (the upper mold) and the lower mold are relatively moved during solidification for pressing and expanding.

Alloys of the type that are capable of forming a bulk metallic glass are represented by the following chemical formulas: $Zr_{55}Al_{10}Ni_5Cu_{30}$; $Zr_{55}Al_{10}Ni_{10}Cu_{25}$; and $Zr_{55}Al_{10}Ni_5Cu_{28}Nb_2$. However, the melt press solidification technique is not limited to any alloy compositions including Cu, Co, Fe, Ni, Pd, and Pt systems, as long as the composition is capable of having a stable supercooled liquid state.

The highly-ductile nano-particle dispersed metallic glass made by the melt press solidification technique of the present invention, provides a draft of 70% or more when cold worked, which can be rolled by a normal cold rolling technique used for any metal materials using reduction rolls or rolling dies to produce materials in form of sheets, bars, wires, and shaped products.

EMBODIMENTS

Embodiments of the present invention are described hereafter.

In FIG. 1, 120 g of an alloy of $Zr_{55}Al_{10}Ni_5Cu_{30}$, prepared in advance, was placed on lower mold 1, made of a water cooled copper mold having flat surface of 90 mm (W)×130 mm (L). The alloy material was completely melted by the arc generated between two electrodes, the tungsten electrode and the copper mold, at 20V and 400 A. The resulting melt puddle was kept as it was on the lower mold while the air driven upper mold was lowered such that the melt puddle could be pressed at 5 $Kg/cm^2$ during solidification. The pressed and expanded metallic glass sheet obtained had the size of 2 mm (D)×2 mm (W)×130 mm (L) and contained nano-particle crystal (3 nm–20 nm) phase by 10 volume %.

The metallic glass obtained by the melt press solidification technique was cut into bars of 2–10 mm for rolling materials. The cold rolled material had a size of 0.28 mm×4 mm×460 mm with a draft of 90%. The sample with a draft of 90% was tested for tensile strength, elastic elongation, and measurements were 1,500 MPa and 2.8% respectively. The elongation ratio was 2.0% before rolling and it increased 40% after rolling. The metallic glass Young's modulus became smaller while its deflection properties improved. Its toughness increased as well such that the metallic glass could not be destroyed when it was bent 90 degrees. The metallic glass alloy of conventional technology, which is not dispersed with nano-particles provide a material of a poor ductility of a draft of 60% or less when cold rolled. In contrast, the metallic glass with nano-particles, obtained by the melt press solidification technique of the present invention, demonstrated high ductility capable of cold rolling with such a draft of 99% when cold rolled.

POTENTIAL INDUSTRIAL APPLICATIONS

The melt press solidification technique of the present invention is a unique technique that can produce a metallic glass that is excellent in cold expansion working properties in processes such as cold rolling. It is also a novel method to produce a metallic glass cold worked product of excellent mechanical strength, such as elastic elongation and bending properties. By taking advantage of excellent cold elongation properties of the metallic glass obtained by the melting press solidification technique, the metallic glass can further be made into metallic glass bars, wires, and sheets having various cross sections.

We claim:

1. A process of making highly-ductile nano-particle dispersed metallic glass providing a draft of above 70% when cold rolled, comprising the step of pressing and expanding an alloy melt of composition capable of being glassified between a lower mold and an upper mold, the lower mold and the upper mold being highly heat-conductive water-cooled molds, so that the alloy melt solidifies under pressure, wherein the upper and lower molds are positioned in relative proximity such that the alloy melt is pressed at 0.5–5 $Kg/cm^2$ therebetween in the direction perpendicular to the expanding direction while the alloy melt is solidifying.

2. A process of making highly-ductile nano-particle dispersed metallic glass recited in claim 1, wherein a water cooled copper mold is loaded with an alloy material of a composition capable of being glassified for forming the metallic glass and the alloy material is melted by an arc melting method.

3. A process of making highly-ductile metallic glass recited in claim 1 or 2, further comprising the step of cold drawing the metallic glass such that said highly ductile metallic glass consists essentially of a single amorphous phase.

4. A process of making highly ductile metallic glass, comprising the steps of:

solidifying an alloy melt of composition capable of being glassified such that nano-particle dispersed metallic glass, comprising an amorphous phase and nano-particles dispersed in the amorphous phase, is obtained, and cold rolling the nano-particle dispersed metallic glass to make the nano-particles disappear.

* * * * *